United States Patent [19]

Beneke et al.

[11] 4,364,153

[45] Dec. 21, 1982

[54] APPARATUS FOR REMOVING WASTE FROM A FIBER PROCESSING MACHINE

[75] Inventors: Wolfgang Beneke; Walter Jäger; Paul Teichmann, all of Monchen-Gladbach, Fed. Rep. of Germany

[73] Assignee: Trützschler GmbH & Co. KG, Monchen-Gladbach, Fed. Rep. of Germany

[21] Appl. No.: 196,109

[22] Filed: Sep. 29, 1980

[30] Foreign Application Priority Data

Dec. 14, 1979 [DE] Fed. Rep. of Germany ..... 2950367

[51] Int. Cl.[3] ..... D01G 15/82

[52] U.S. Cl. ..... 19/107; 19/200

[58] Field of Search ..... 19/98, 99, 107, 200, 19/205

[56] References Cited

U.S. PATENT DOCUMENTS

| | | | |
|---|---|---|---|
| 2,284,750 | 6/1942 | Landreth | 19/107 X |
| 3,387,318 | 6/1968 | Nagel et al. | 19/107 |
| 3,881,224 | 5/1975 | Wirth | 19/107 |
| 4,092,764 | 6/1978 | Thomas et al. | 19/107 |
| 4,229,286 | 10/1980 | Bridges | 19/200 |

FOREIGN PATENT DOCUMENTS

| | | | |
|---|---|---|---|
| 1292551 | 11/1969 | Fed. Rep. of Germany . | |
| 1019768 | 2/1966 | United Kingdom | 19/107 |
| 1066987 | 4/1967 | United Kingdom | 19/107 |
| 311991 | 9/1971 | U.S.S.R. | 19/107 |

*Primary Examiner*—Louis Rimrodt

*Attorney, Agent, or Firm*—Spencer & Kaye

[57] ABSTRACT

A fiber processing machine has rotary components, a shroud surrounding the components at least laterally and from above, a suction apparatus including at least one suction head situated in the space surrounded by the shroud for drawing away, by means of an air stream, fiber waste released during operation of the machine. There is provided at least one blower head which is located between the rotary components and the shroud for introducing pressurized air into the space surrounded by the shroud.

12 Claims, 5 Drawing Figures

APPARATUS FOR REMOVING WASTE FROM A FIBER PROCESSING MACHINE

BACKGROUND OF THE INVENTION

This invention relates to a fiber processing machine having rotary components, particularly a flats card or a roller card and further having a shroud which covers the rotary components at least on the top and on the side, including the bearings of the rotary components. The machine further has a suction device including at least one suction head for removing waste, such as dust and fiber fragments or other impurities by an air flow.

In fiber processing machines such as roller cards, it is conventional to surround the rotary components with a shroud from which the dusty air is removed by suction. The air quantities necessary for equalization enter the shroud, for example, from the spinning chamber. Such an arrangement however, lacks controlled flow conditions and further, the aerodynamic conditions underneath the shroud are not constant.

SUMMARY OF THE INVENTION

It is an object of the invention to provide an improved fiber processing machine of the above-outlined type from which the above-discussed disadvantages are eliminated and which in particular, ensures an aerodynamic equilibrium underneath the shroud.

This object and others to become apparent as the specification progresses, are accomplished by the invention, according to which, briefly stated, between the shroud and the rotary components there is provided at least one blower head which introduces pressurized air into the space surrounded by the shroud.

The fiber processing machine according to the invention is fully covered by the shroud. Thus, the shroud extends also over the carding elements which, for example, in case of a flats card, may be the traveling flats and/or the fixed flats and which, in case of a roller card, may be the worker or the turner. Between the shroud and the rotary components there is provided at least one, but preferably a plurality of blower heads. Further, underneath the shroud there is situated at least one, but preferably a plurality of suction heads, so that a vacuum is generated which prevents dust from entering the spinning chamber. The outlet of the blower head is oriented in the direction of the suction head. In this manner there is provided an aerodynamic connection between the blower heads and the suction heads, that is, it is ensured that a tangential (Coanda effect) and diffused air flow passes through the inner space of the shroud in all zones. The air quantities introduced and induced by the blower heads correspond to the air quantities removed by means of the suction heads so that an aerodynamic equilibrium is maintained. Thus, as a result, there will be a well-determined inflow of pressurized air into the shroud. The quantity (flow rate) of the pressurized air is equal to or less than the quantity (flow rate) of the suction air. In the latter case, fresh air is drawn additionally from the spinning chamber into the blower chamber. In no event does, however, dust-laden air flow from the inner space of the shroud into the spinning chamber.

The fiber fragments, dust and microdust which are released during the carding of the fiber material are very effectively removed by suction. Thus, dust and waste are removed by suction from all areas of occurence such as tuft feed shaft, flats inlet, flat strips, corner zones between the carding cylinder and the doffer, web zone and waste accumulating chamber underneath the card. Such a suction arrangement satisfies the increasing requirements for a dust-free condition of the carding chamber, based on environmental considerations. The suction arrangement also reduces the generation of dust in machines arranged downstream of the card. Above all, the running conditions of the card and the downstream-arranged machines and thus their degree of efficiency and economic operation as well as the quality of the yarn are improved. This beneficial effect can be particularly felt in rotary spinning.

The invention may find application also in arrangements where the blower heads, although located in the lower carding chamber, cause their pressurized air current to be effective at least in part in the upper carding chamber. The upper carding chamber extends above the approximate horizontal center line of the feed roll, the lickerin, the carding cylinder, the doffer, the stripping roll, the squeezing rolls, the trumpet and the calender rolls, while the lower carding chamber extends underneath the approximate center line of these elements. It is further feasible to utilize, as pressurized air, the exhaust air from the air outlet openings of the tuft feed shaft arranged upstream of the card, by directing such pressurized air towards the card.

Preferably, in the upper carding chamber adjacent the shroud there is arranged at least one blower head. Expediently, the blower head extends over the entire width of the shroud so that over the entire shroud width uniform air flow, particularly pressurized air flow may be effected. This arrangement also ensures that a significant air quantity is introduced.

According to a further advantageous feature of the invention, the blower head is arranged at the lower edge of the shroud. If, in a preferred manner, a blower head is located at the rear and frontal lower edge of the shroud, the pressurized air currents may be received by means of a suction head situated between the two blower heads.

According to a further advantageous feature of the invention, the blower head is situated in the zone of the upstream material inlet, that is, above the feeding roll or the lickerin. It may be further of advantage to arrange the blower head in the zone above the flats (traveling flats and/or stationary flats). It is also advantageous to arrange the blower head in the zone above the fiber discharge zone, that is, above the doffer, the stripper roll, the squeezing rolls and the calender assembly. In case the dust-laden air is taken from the suction head of a filter arrangement and is, from the filter arrangement directed at least in part to the blower head, a partial or total circulating air system may be obtained.

According to a particularly advantageous feature of the invention, the blower head is designed as an injector nozzle which draws air from the zone externally of the shroud and blows the air into the space surrounded by the shroud.

Expediently, the outlet of the blower head is oriented towards one of the suction heads; in this manner directed and uniform air streams may be realized.

According to a further advantageous feature of the invention, at least one blower head is arranged inside the traveling flat bars; the air outlet openings of the blower head are oriented in the direction of the end rollers of the flats. Expediently, the blower head is arranged approximately in the middle between the end rollers of the flats and thus has an effect on end rollers at both ends of the flats. Preferably, the shroud is sealed from the lower carding chamber. In this manner there is effected a separation between the upper and the lower carding chambers as well as the drive chamber.

DESCRIPTION OF THE PREFERRED EMBODIMENTS

Figure 1:
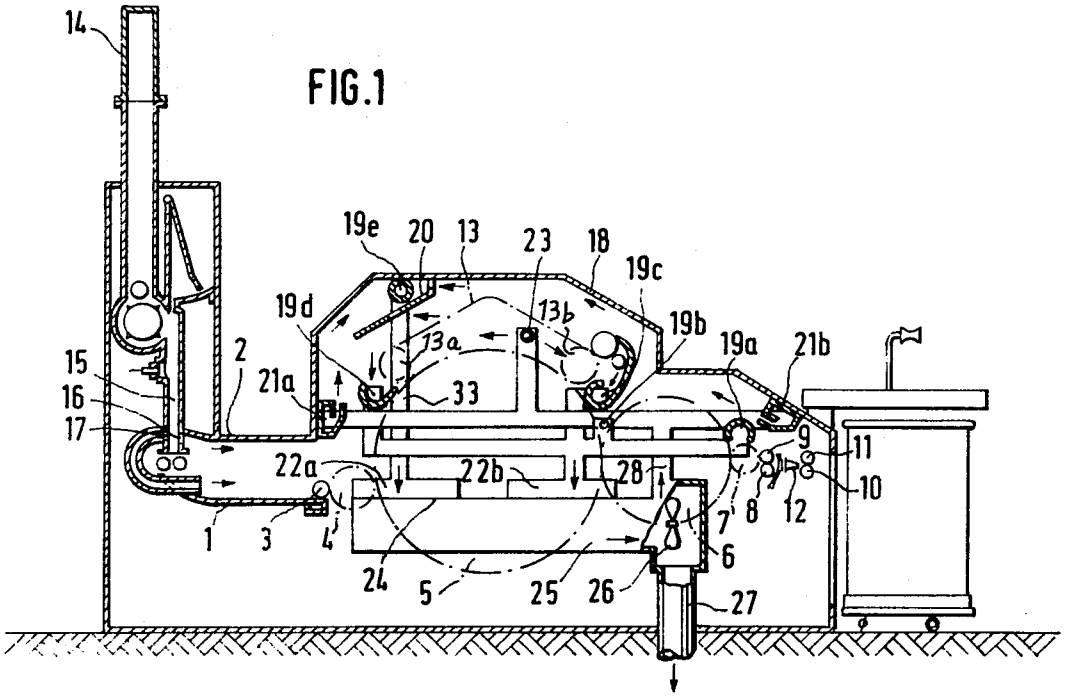
FIGS. 1 through 4 are schematic side elevational views of a fiber processing machine incorporating four preferred embodiments of the invention.

Turning now to FIG. 1, there is shown a carding machine which has a transfer table 1, a cover 2 arranged thereabove, a feed roll 3, a lickerin 4, a carding cylinder 5, a doffer 6, a web take-off roller 7, squeezing rolls 8 and 9, calender rolls 10 and 11 as well as a silver trumpet 12. Above the cylinder 5 there are arranged traveling flats 13 supported by an upstream end roller 13*a* and a downstream end roller 13*b*. Upstream of the carding machine there is arranged a tuft feeding assembly 14 including a feeding shaft 15 which has air outlet openings 16 and 17. A shroud 18 is arranged over the card and encloses the rotary components 3 through 11 from the top and laterally, including their bearings. Underneath the shroud 18 there are arranged suction devices constituted by suction heads 19*a* (above the corner zone between the doffer 6 and the web take-off roller 7), 19*b* (above the corner zone between the carding cylinder 5 and the doffer 6), 19*c* (underneath the end roller 13*b*), 19*d* (underneath the end roller 13*a*) and 19*e* (above the traveling flats 13). An apertured air guide baffle 20 is associated with the suction head 19*e*. Between the shroud 18 and the rotary components 3 through 11 there are arranged two blower heads 21*a* and 21*b* along the entire width of the shroud 18. The blower head 21*a* is situated approximately at the upstream lower edge of the shroud 18 in the zone of the fiber tuft inlet of the carding machine above the feed roll 3 and the lickerin 4, whereas the blower head 21*b* is situated approximately at the lower downstream edge of the shroud 18 in the zone of the fiber material outlet above the squeezing rolls 8 and 9, the sliver trumpet 12 and the calender rolls 10 and 11. The outlet of the blower heads 21*a* and 21*b* is oriented in the direction of the respective suction heads 19*a* through 19*e*. The dust-laden air from the suction heads 19*a* through 19*e* is admitted to a filter assembly comprising two filter boxes 22*a*, 22*b* and a filter 24. The blower heads are coupled to a pressurized air generator, such as a blower (not shown).

Inside the traveling flat bars (not shown) of the traveling flats 13 there is situated an additional blower head 23 which is formed, for example, of a perforated or slotted pipe and which extends over the width of the traveling flats 13. The lateral pressurized air outlets of the blower head 23 are oriented towards the end rollers 13*a* and 13*b* supporting the flats 13. The blower head 23 is situated approximately in the middle between the two end rollers of the flats.

The dust-laden air flows, for example, from the suction head 19*e* through the pipe 33 into the filter box 22; then flows through the filter 24 into the box 25 and is removed therefrom by the suction effect of a blower 26. The blower 26 drives one part of the air into a conduit 27 while another part of the air is admitted through the conduit 28, for example, into the blower head 21*b*. Thus, pressurized air exits from the blower head 21*b*; the air flows in the direction of the suction head 19*e*. As the air flows out of the blower head 21*b*, it entrains fresh air into the shroud 18 from the spinning chamber.

From the air outlet openings 16, 17 of the feed shaft 15 the used air flows through the space between the transfer table 1 and the cover 2 in the direction of the zone above the feed roll 3 and the lickerin 4 and is then removed by suction.

Figure 2:
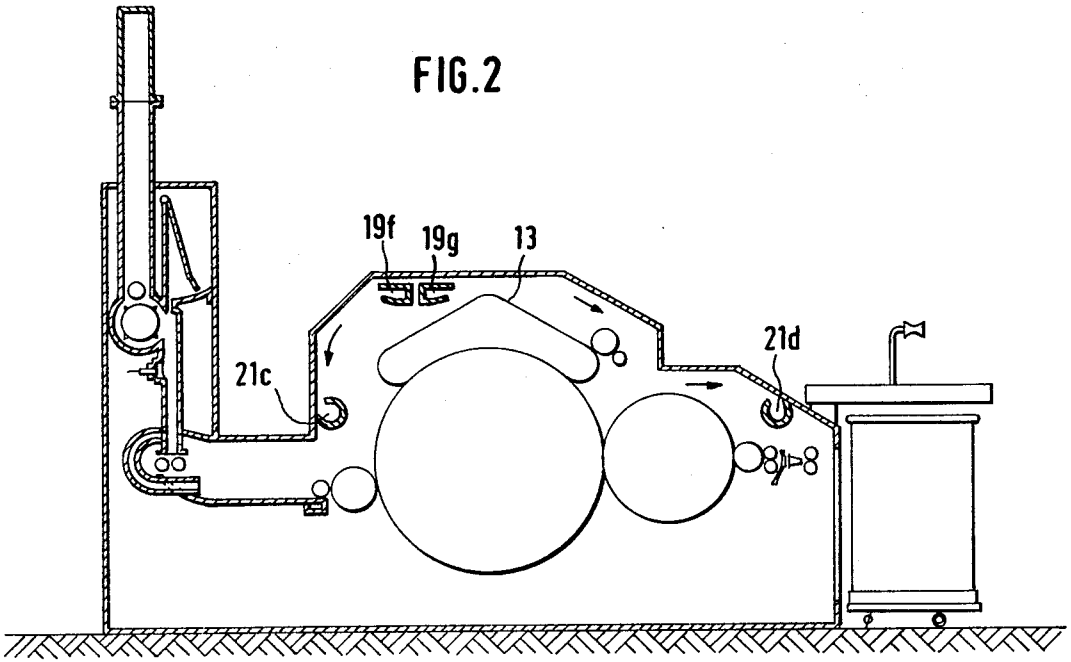

Turning now to FIG. 2, the embodiment shown therein comprises two blower heads 19*f* and 19*g* above the traveling flats 13. The outlets of the respective blower heads 19*f* and 19*g* are oriented towards two respective suction heads 21*c* and 21*d*. The suction heads 21*c* and 21*d* are situated above the intake zone and the discharge zone of the carding machine.

Figure 3:
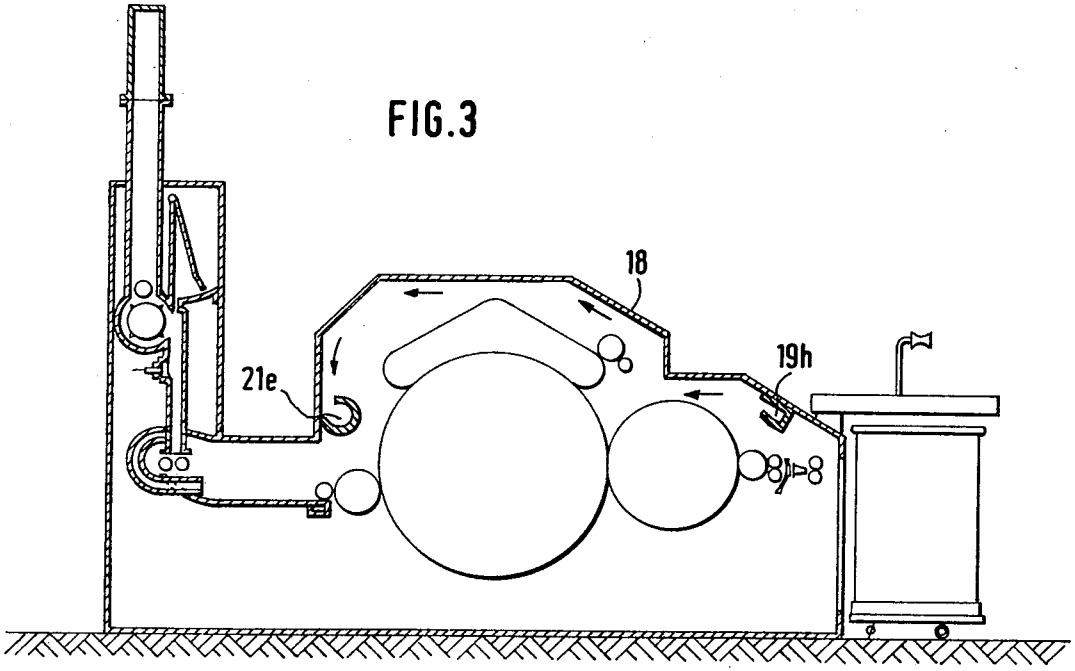

Turning now to the embodiment illustrated in FIG. 3, there is shown a blower head 19*h* situated at the lower downstream edge zone of the shroud 18. The outlet of the blower head 19*h* is oriented towards a suction head 21*e* which, in turn, is situated at the lower upstream edge zone of shroud 18.

Figure 4:
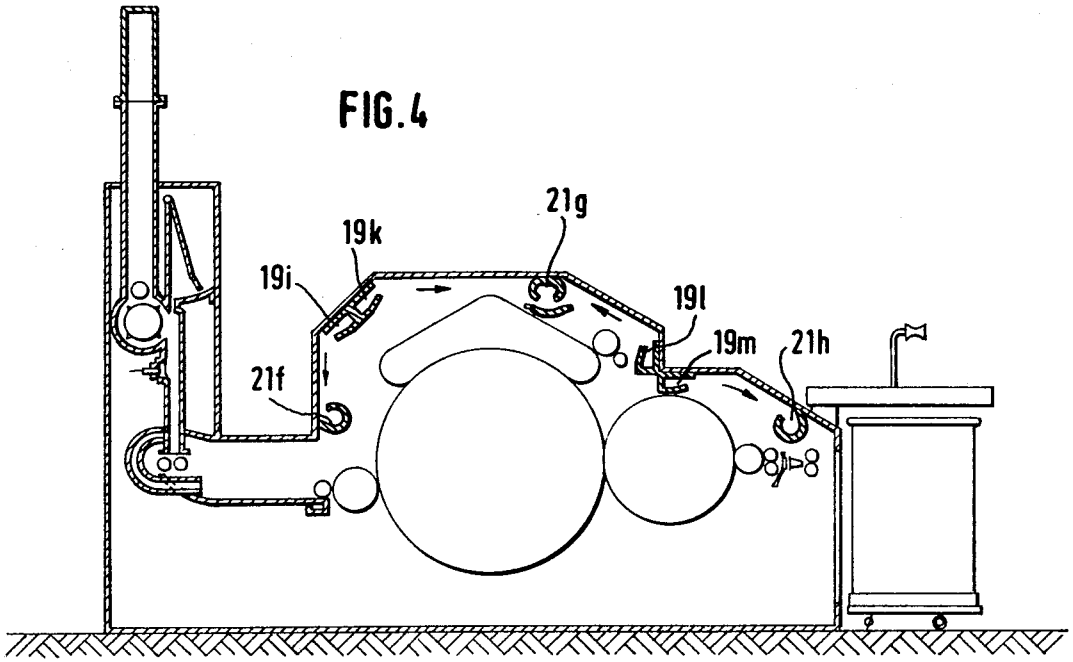

In the embodiment according to FIG. 4, there are provided four blower heads 19*i*, 19*k*, 19*l* and 19*m* as well as three suction heads 21*f*, 21*g* and 21*h*.

Figure 5:
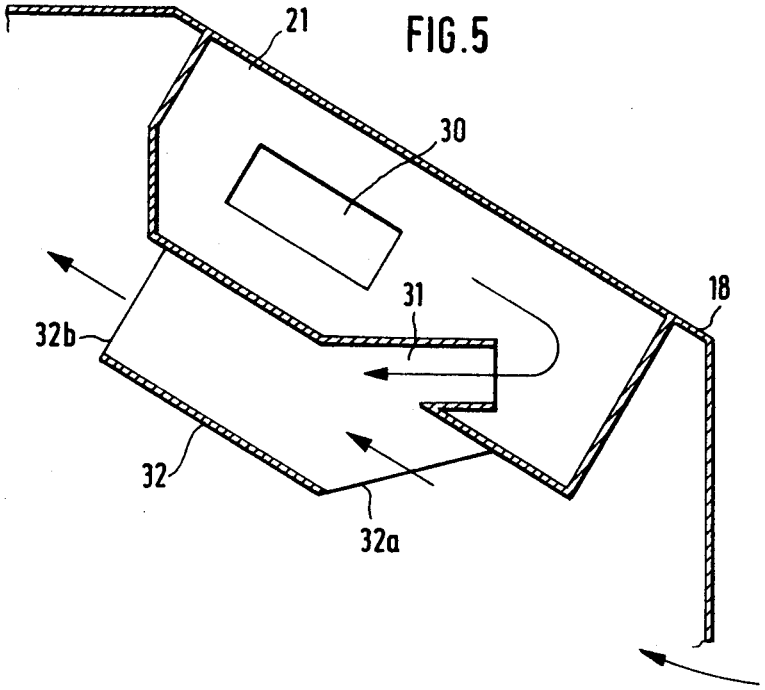
FIG. 5 is a schematic side elevational view of a component of a preferred embodiment of the invention.

Turning now to FIG. 5, there is illustrated a blower head 21 which is structured as an injector nozzle. The air is supplied from the zone externally of the shroud 18, that is, from the spinning chamber, and is delivered into the space underneath the shroud 18. The blower head 21 has a supply air inlet 30 from which the air is admitted through an obliquely oriented nipple 31 into a tube portion 32 having an inlet 32*a* and an outlet 32*b*. The air entering into the tube portion 32 from the nipple 31 entrains air through the inlet 32*a*. Both air streams leave the tubular portion 32 through the outlet 32*b* and travel towards one of the suction heads situated in the space surrounded by the shroud 18, as described above.

It will be understood that the above description of the present invention is susceptible to various modifications, changes and adaptations and the same are intended to be comprehended within the meaning and range of equivalents of the appended claims.

What is claimed is:

1. A carding machine having length and width dimensions, comprising in combination:

(a) a plurality of rotary roll and drum components arranged in said length dimension and each having a rotary axis oriented parallel to said width dimension;

(b) a shroud extending along said length dimension and enclosing said components on top and along opposite sides;

(c) a blower head situated in a radial space bounded, at opposite sides of said blower head, by said shroud and a periphery of one of said components; said blower head having a defined blower opening oriented parallel to and extending along substantially the entire width dimension;

(d) air pressurizing means connected to said blower head for introducing pressurized air into said blower head for discharging said pressurized air through said blower opening;

(e) a suction head situated in a radial space bounded, at opposite sides of the suction head, by said shroud and a periphery of one of said components; said suction head having a defined suction opening oriented parallel to and extending along substantially the entire width dimension; said suction head being spaced from said blower head transversely to said width dimension; said blower opening being directed towards said suction head; and (f) air withdrawing means connected to said suction head for withdrawing air, flowing in said space from said blower head, through said suction opening.

2. A carding machine as defined in claim 1, having upper and lower carding chambers; said shroud bounding at least said upper carding chamber; said blower head being situated in said upper carding chamber.

3. A carding machine as defined in claim 1, wherein said blower head is situated at a lower border zone of said shroud.

4. A carding machine as defined in claim 1, wherein said shroud has an upstream zone and a downstream zone as viewed in the direction of material advance in the carding machine; and further wherein at least one blower head each is situated in a lower upstream border zone and a lower downstream border zone of said shroud.

5. A carding machine as defined in claim 1, wherein said carding machine has an inlet for receiving the fiber to be processed by said carding machine, said blower head is situated at said inlet.

6. A carding machine as defined in claim 1, wherein said carding machine comprises flats and further wherein said blower head is situated in a zone above said flats.

7. A carding machine as defined in claim 1, wherein said carding machine has an outlet for discharging a fiber web processed by said carding machine; further wherein said blower head is situated in a zone above said outlet.

8. A carding machine as defined in claim 1, further comprising filter means connected to said suction head for receiving dust-laden air from said suction head and means connecting said filter means with said blower head for introducing filtered air into said blower head.

9. A carding machine as defined in claim 1, wherein said blower head comprises an injector nozzle; said air pressurizing means drawing air from the outside of said shroud and introducing air into the space surrounded by said shroud.

10. A carding machine as defined in claim 1, wherein said carding machine has traveling flats supported by end rollers; further wherein said blower head is situated in a space surrounded by the flats; and further wherein said blower head has outlets oriented towards said end rollers.

11. A carding machine as defined in claim 10, wherein said blower head is situated approximately in the middle between said end rollers.

12. A carding machine as defined in claim 1, having upper and lower carding chambers; further wherein said shroud seals said upper carding chamber from said lower carding chamber.

* * * * *